US009065229B2

(12) United States Patent
Yamaguchi et al.

(10) Patent No.: US 9,065,229 B2
(45) Date of Patent: Jun. 23, 2015

(54) USB PLURAL PROTOCOL CONNECTOR SYSTEM

(71) Applicant: Kabushiki Kaisha Toshiba, Minato-ku (JP)

(72) Inventors: Ryohei Yamaguchi, Fujisawa (JP); Takeshi Ikuta, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 8 days.

(21) Appl. No.: 13/967,499

(22) Filed: Aug. 15, 2013

(65) Prior Publication Data

US 2014/0242849 A1 Aug. 28, 2014

(30) Foreign Application Priority Data

Feb. 22, 2013 (JP) ..... 2013-033671

(51) Int. Cl.
*H01R 24/00* (2011.01)
*H01R 29/00* (2006.01)

(52) U.S. Cl.
CPC ..... *H01R 29/00* (2013.01)

(58) Field of Classification Search
USPC ..... 439/660, 626, 676, 166; 361/728
IPC ..... H01R 24/60
See application file for complete search history.

(56) References Cited

U.S. PATENT DOCUMENTS

| | | | | |
|---|---|---|---|---|
| 7,249,978 | B1 * | 7/2007 | Ni | 439/660 |
| 7,649,734 | B2 | 1/2010 | Okumura | |
| 7,685,363 | B2 | 3/2010 | Lin et al. | |
| 7,909,654 | B2 | 3/2011 | He et al. | |
| 7,980,868 | B2 * | 7/2011 | Chou et al. | 439/131 |
| 8,206,162 | B1 * | 6/2012 | Hsieh et al. | 439/131 |
| 2007/0143543 | A1 | 6/2007 | Lin et al. | |
| 2008/0093720 | A1 | 4/2008 | Hiew et al. | |
| 2009/0141440 | A1 | 6/2009 | Okumura | |
| 2010/0279526 | A1 | 11/2010 | Chiang | |
| 2010/0304611 | A1 | 12/2010 | He et al. | |
| 2012/0231673 | A1 | 9/2012 | Hayashi et al. | |

FOREIGN PATENT DOCUMENTS

| | | |
|---|---|---|
| JP | 2007-87260 | 4/2007 |
| JP | 2007-172598 | 7/2007 |
| JP | 2008-218245 | 9/2008 |
| JP | 2010-282964 | 12/2010 |
| JP | 2012-190614 | 10/2012 |

OTHER PUBLICATIONS

USB 3.0 Connector Pinout Diagram @ pinoutsguide.com Printed Oct. 15, 2014.*

* cited by examiner

*Primary Examiner* — Vanessa Girardi

(74) *Attorney, Agent, or Firm* — Oblon, McClelland, Maier & Neustadt, L.L.P.

(57) ABSTRACT

A USB device has a substrate on which a plurality of USB 2.0 pads and a plurality of USB 3.0 pads are arranged on a fore side of the substrate, a male connector's fore-end part configured to surround the USB 2.0 pads and the USB 3.0 pads, a housing configured to be joined to a base end of the male connector's fore-end part in order to cover at least a rear side of the substrate, and a plurality of lead wires each configured to have one end fixed to an inner surface of the housing and the other end contacted to the USB 3.0 pad corresponding to the lead wire.

10 Claims, 2 Drawing Sheets

USB PLURAL PROTOCOL CONNECTOR SYSTEM

CROSS REFERENCE TO RELATED APPLICATIONS

This application is based upon and claims the benefit of priority from the prior Japanese Patent Application No. 2013-33671, filed on Feb. 22, 2013, the entire contents of which are incorporated herein by reference.

FIELD

Embodiments of the present invention relate to a USB device capable of being fitted into a USB connector, and to a USB system.

BACKGROUND

USB devices compliant with the USB standard are used in various devices such as memory device, wireless device, TV tuner, etc. Recently, products compliant with the standard of USB 3.0, which offers higher speed than USB 2.0, have been increasing.

Since USB is upward compatible, a USB device compliant with the USB 3.0 standard can communicate also with a USB device compliant with the USB 2.0 standard. Accordingly, a USB device connector for USB 3.0 has pads for USB 3.0 and pads for USB 2.0.

A portable USB device generally has a male connector. By fitting this male connector into a female connector, USB 2.0 pads of the connectors are electrically connected and USB 3.0 pads of the connectors are also electrically connected. In this way, communication compliant with the USB standard is realized.

Such a male connector needs complicated manufacturing processes in which lead wires are contacted with the insulators to position the lead wires, and then are contacted with the USB 3.0 pads, in order to contact the lead wires with the USB 3.0 pads formed on a USB compatible chip housing a controller for USB communication or the like.

DETAILED DESCRIPTION

Figure 1:
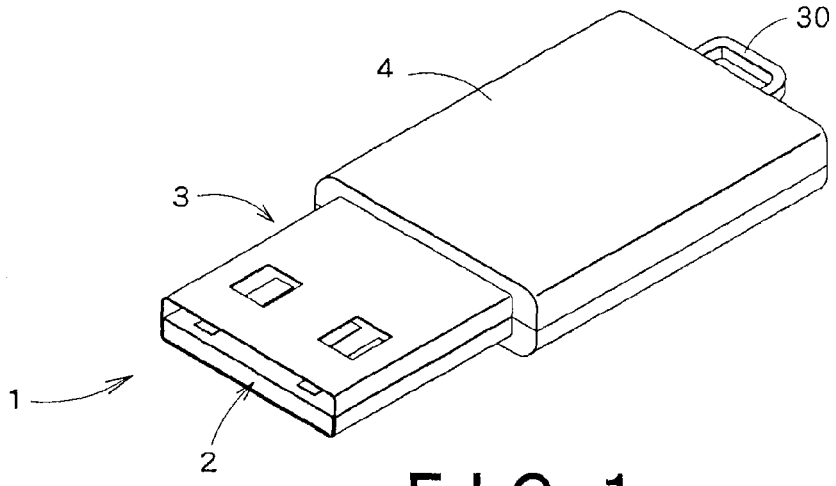
FIG. 1 is a perspective diagram showing an outer appearance of a USB device 1 according to an embodiment of the present invention.

According to one embodiment, a USB device has a substrate on which a plurality of USB 2.0 pads and a plurality of USB 3.0 pads are arranged on a fore side of the substrate, a male connector's fore-end part configured to surround the USB 2.0 pads and the USB 3.0 pads, a housing configured to be joined to a base end of the male connector's fore-end part in order to cover at least a rear side of the substrate, and a plurality of lead wires each configured to have one end fixed to an inner surface of the housing and the other end contacted to the USB 3.0 pad corresponding to the lead wire.

Embodiments will now be explained with reference to the accompanying drawings.

Hereinafter, an embodiment of the present invention will be explained referring to the drawings.

Figure 2:
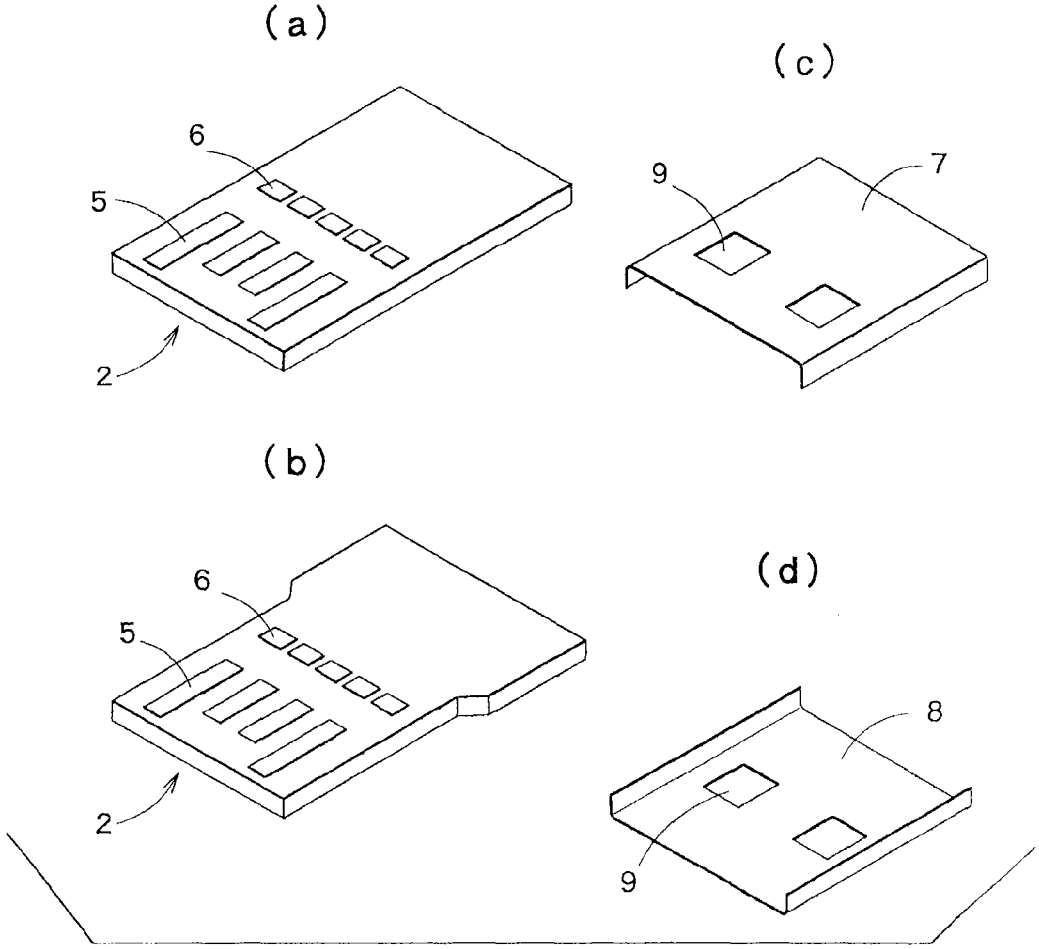
FIG. 2 is a perspective diagram of members constituting the USB device 1 of FIG. 1.
Figure 3:
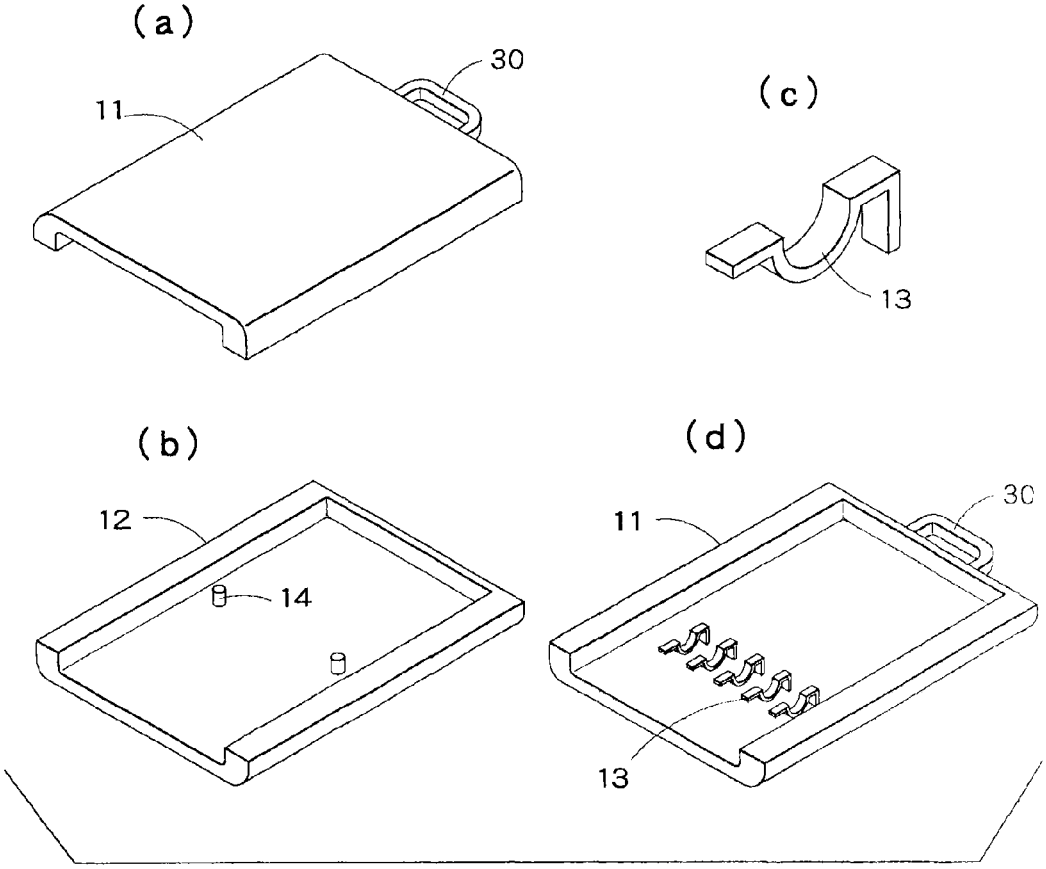
FIG. 3 is a perspective diagram of members constituting the USB device 1 of FIG. 1.

FIG. 1 is a perspective diagram showing an outer appearance of a USB device 1 according to an embodiment of the present invention, and each of FIGS. 2 and 3 is a perspective diagram of members in the USB device 1 of FIG. 1. The USB device 1 of FIG. 1 is characterized in compliant with USB 1.x, USB 2.0, and USB 3.0. Even when the USB 2.0 or USB 3.0 standard is revised to a new version in the future, such as USB 2.x and USB 3.x, the present embodiment is applicable as long as the terminal arrangement is the same. In this specification, USB 2.x is recited as USB 2, and USB 3.x is recited as USB 3, where x includes all the versions.

The USB device 1 according to the present embodiment has a substrate 2, a male connector's fore-end part 3, and a housing 4. Four USB 2.0 pads 5 and five USB 3.0 pads 6 are arranged on the top surface of the substrate 2 in compliance with the USB standard. Various circuits for performing communication through the USB 2.0 pads 5 and USB 3.0 pads 6 may be formed on the substrate 2, or an IC for processing a certain kind of information may be implemented or incorporated in the substrate 2. Instead, only the USB 2.0 pads 5 and USB 3.0 pads 6 may be formed on the substrate 2. Further, another member may be additionally provided to be incorporated in the housing 4 together with the substrate 2.

The substrate 2 may be rectangular as shown in FIG. 2(*a*), or may be formed so that the width on the housing side is wider than that on the opposite side as shown in FIG. 2(*b*). The actual shape and size of the substrate 2 should be determined arbitrarily, and the longitudinal length of the substrate 2 also should be determined arbitrarily.

The male connector's fore-end part 3 is arranged to surround the USB 2.0 pads 5 and USB 3.0 pads 6 on the substrate 2. The male connector's fore-end part 3 may be formed as one tubular member, or may be formed of an upper molding 7 shown in FIG. 2(*c*) and a lower molding 8 shown in FIG. 2(*d*). Instead, the male connector's fore-end part 3 may be formed of two moldings which can be separated to right and left. The male connector's fore-end part 3 has, on each of the top surface and the bottom surface, two holes 9 which engage with spring members of a female connector (not shown). Further, the male connector's fore-end part 3 may be integrated with the housing 4.

The housing 4 is joined to the base end of the male connector's fore-end part 3 in order to cover at least the rear side of the USB 3.0 pads 6 on the substrate 2. The housing 4 is formed of an upper molding 11 shown in FIG. 3(*a*) and a lower molding 12 shown in FIG. 3(*b*), for example. As shown in FIG. 3(*d*), one ends of five lead wires 13 are fixed to the inner surface of the upper molding 11. The other ends of the lead wires 13 are contacted with the USB 3.0 pads 6 on the substrate 2. The one end of each lead wires 13 is connected to, e.g., a circuit (not shown) on the substrate 2 or a cable joined to the housing 4, through a conductive wire or a conductive pattern (not shown) provided in the housing 4. That is, the lead wires 13 pass the signals transmitted and received through the USB 3.0 pads 6.

As shown in FIG. 3(*b*), two positioning members 14 are laterally arranged on the inner surface of the lower molding 12 of the housing 4. These positioning members 14 are used to position the substrate 2 in order not that the longitudinal end of the substrate 2 is arranged beyond the positioning members 14 when the substrate 2 to be housed in the housing 4 has a short longitudinal length.

When the substrate 2 having a longitudinal length larger than a longitudinal length of the positioning members 14 is housed in the housing 4, the thickness of the substrate 2 should be made smaller so that the substrate 2 can be housed in the housing 4 regardless of the location of the positioning members 14. Further, the substrate 2 to be housed has a length matching to the length of the housing 4, the positioning members 14 are not required, which means that the positioning members 14 may be omitted.

As stated above, the USB device 1 according to the present embodiment is characterized the lead wires 13 are fixed to the inner surface of the housing 4 while forming the USB 2.0 pads 5 and USB 3.0 pads 6 on the substrate 2. This makes it possible to position the lead wires 13 easily.

Next, explanation will be given on a procedure for assembling the USB device 1 according to the present embodiment. First, resin is poured into a metal mold for the upper molding 11 of the housing 4 shown in FIG. 3(*a*) with the upper molding 11 of the male connector's fore-end part 3 shown in FIG. 2(*c*) being positioned at a predetermined location, to integrate the upper molding 11 of the housing 4 shown in FIG. 3(*a*) and the upper molding 7 of the male connector's fore-end part 3 shown in FIG. 2(*c*) (Process 1). Hereinafter, the assembled structure produced by Process 1 is referred to as an upper molding structure.

Around the time of Process 1, resin is poured into a metal mold for the lower molding 12 of the housing 4 with the lower molding 8 of the male connector's fore-end part 3 shown in FIG. 2(*d*) and the lead wires 13 shown in FIG. 3(*c*) being positioned at predetermined locations, to integrate the lower molding 12 of the housing 4 shown in FIG. 3(*b*), the lower molding 8 of the male connector's fore-end part 3 shown in FIG. 2(*d*), and the lead wires 13 shown in FIG. 3(*c*) (Process 2). Hereinafter, the assembled structure produced by Process 2 is referred to as a lower molding structure.

Next, the substrate 2 is positioned inside the lower molding structure produced by Process 2. When the longitudinal length of the substrate 2 is shorter than the longitudinal length of the lower molding structure, the positioning members 14 as shown in FIG. 3(*b*) are provided inside the lower molding structure so that the substrate 2 is positioned to come into contact with the positioning members 14 (Process 3).

Next, the substrate 2 is covered with the upper molding structure produced by Process 1, and the upper molding structure and the lower molding structure are sealed (Process 4).

Figure 4:
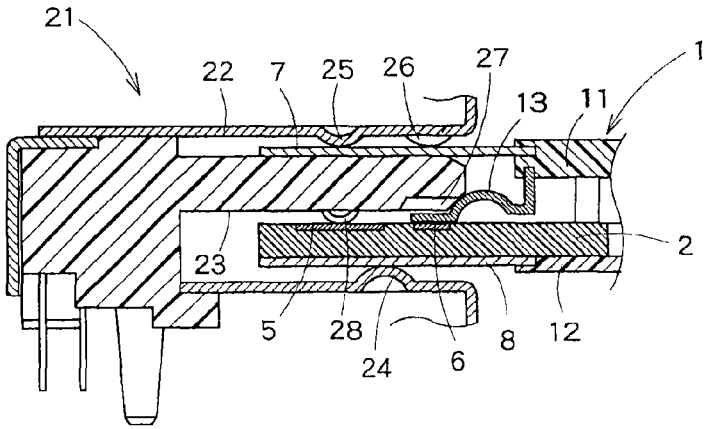
FIG. 4 is a cross-sectional diagram showing a state where the USB device 1 according to the present embodiment is fitted into a female connector 21 of a communication partner device.

FIG. 4 is a cross-sectional diagram showing a state where the USB device (first USB device) 1 according to the present embodiment is fitted into a female connector 21 of a communication partner device (second USB device). The USB device 1 and communication partner device constitute a USB system. As shown in FIG. 4, the female connector 21 has a fixing member 22 which is engaged with the holes 9 of the male connector's fore-end part 3 in order to fix the male connector's fore-end part 3, and a protruding member 23 which is inserted into a USB male connector.

The fixing member 22 has, on its inner surface, first spring members 24 which are engaged with the holes 9 formed at the bottom of the lower molding 8 of the male connector's fore-end part 3, second spring members 25 which are engaged with the holes 9 formed at the top of the upper molding 7 of the male connector's fore-end part 3, and an auxiliary spring member 26 which is arranged adjacent to the second spring members 25.

The protruding member 23 has, on its bottom surface, USB 3.0 connection terminals 27 and USB 2.0 connection terminals 28.

When the USB device 1 is fitted into the female connector 21, the USB 2.0 pads 5 of the USB device 1 contact with the USB 2.0 connection terminals 28 of the female connector 21, and the lead wires 13 contacted with the USB 3.0 pads 6 of the USB device 1 contact with the USB 3.0 connection terminals 27 of the female connector 21. When the USB device 1 is pushed into the female connector 21, the lead wires 13 are pushed onto the fore-end part of the protruding member 23 of the female connector 21, by which the USB 3.0 connection terminals 27, lead wires 13, and USB 3.0 pads 6 are pressed to one another more tightly. Accordingly, the USB 3.0 pads and the USB 3.0 connection terminals 27 can be electrically connected stably.

Further, the first spring members 24 on the inner surface of the fixing member 22 of the female connector 21, the second spring members 25, and the auxiliary spring member 26 are engaged with the male connector's fore-end part 3 of the USB device 1 to push the male connector's fore-end part 3 upward and downward, which further stabilizes the connection between the USB 2.0 pads 5 and the USB 2.0 connection terminals 28 and the connection between the USB 3.0 pads 6 and the USB 3.0 connection terminals 27. In this way, a bad connection can be prevented.

As stated above, various circuits may be formed on the substrate 2, or various ICs may be mounted on the substrate 2. For example, a memory chip and its controller may be formed or mounted on the substrate 2 as a circuit or an IC. Instead, an IC or a circuit having a wireless communication function for wireless LAN, cellular communication, Bluetooth (registered trademark), etc. may be formed or mounted on the substrate 2. Further, various information processing circuits for transmitting and receiving data in compliance with the USB standard may be formed or mounted on the substrate 2. Furthermore, another substrate 2 or another member may be connected to the substrate 2.

The housing 4 of the USB device 1 according to the present embodiment may have a strap hole 30 as shown in FIG. 1. Further, the housing 4 may have an LED so that the user can see whether data is being currently transmitted and received between the USB device 1 and a host device having the female connector 21. The LED to be used in this case lights or flashes on and off while data is transmitted and received, for example. Further, when the USB device 1 is used for wireless communication, a plurality of LEDs may be provided to inform wireless communication situations.

The USB device 1 according to the present embodiment may be used simply as a USB male connector. In this case, only the USB 2.0 pads 5 and USB 3.0 pads 6 should be formed on the substrate 2. Further, the USB male connector may be connected to another connector through a cable. Instead, the USB device 1 according to the present embodiment may be a connector converter for converting the shape of a connector.

The USB device 1 according to the present embodiment may be a card reader. In this case, a card socket into which one or more kinds of memory cards can be inserted should be provided on the substrate 2 or another substrate 2.

The USB device 1 according to the present embodiment may have an imaging device such as CCD sensor, CMOS sensor, etc. to function as a digital camera.

The USB device 1 according to the present embodiment may function as a hub for a LAN. Further, The USB device 1 according to the present embodiment may function as a pointing device such as mouse, pointer, track ball, controller, etc.

The USB device 1 according to the present embodiment may have a function for image processing such as video capture. Further, the USB device 1 according to the present embodiment may function as a mobile electronic device such as toy, game machine, etc.

The USB device 1 according to the present embodiment may have a function for various types of biometric authentication such as fingerprint authentication.

The USB device 1 according to the present embodiment may have a function of USB Composite Device Class or USB Storage (Mass Storage) Device Class in compliance with the USB-IF standard.

The USB device 1 according to the present embodiment should not necessarily comply with the USB-IF standard as long as the arrangement of the USB 2.0 pads 5 and USB 3.0 pads 6 complies with the USB standard.

As stated above, the substrate 2 of the USB device 1 according to the present embodiment can be simplified since at least the USB 2.0 pads 5 and USB 3.0 pads 6 should be provided on the substrate 2. Further, by previously fixing the lead wires 13 to the inner surface of the housing 4, a process for positioning the lead wires 13 can be omitted when fixing the substrate 2 to the housing 4, which leads to improvement of work efficiency.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A USB device comprising:

a substrate on which a two groupings of conductive pads on one surface of a substrate are arranged, a first grouping comprising four conductive pads and a second grouping comprising five conductive pads;

a male connector's fore-end part configured to surround the first grouping and the second grouping;

a housing configured to be joined to a base end of the male connector's fore-end part in order to cover at least a rear side of the substrate; and a plurality of lead wires each configured to have one end fixed to an inner surface of the housing and each being aligned with the second grouping corresponding to the lead wire, wherein when the male connector's fore-end part is inserted into a USB female connector of a communication partner device, the lead wires are configured to be pushed onto the second grouping corresponding thereto by the USB female connector, and each of the lead wires comprises a curved part configured to be contacted with the USB female connector when the USB female connector receives the male connector's fore-end part, and a fore-end part of the male connector configured to be arranged closer to a leading end of the lead wire than the curved part in order to be pushed onto the second grouping correspond to the lead wire when the curved part is contacted with the USB female connector.

2. The USB device of claim 1, wherein the housing comprises a first housing and a second housing vertically superposed on each other, and the lead wires are provided on an inner surface of one of the first housing and the second housing.

3. The USB device of claim 1, wherein the housing comprises a hole for putting a strap therethrough.

4. The USB device of claim 1, wherein the housing comprises a positioning member configured to position the substrate.

5. The USB device of claim 4, wherein the housing comprises a first housing and a second housing vertically superposed on each other, and the positioning member is provided on an inner surface of one of the first housing and the second housing which is different from the other housing having the lead wires.

6. A USB system comprising:

a first USB device configured to comprise a USB male connector compatible both with two groupings of conductive pads on one surface of a substrate, a first grouping comprising four conductive pads and a second grouping comprising five conductive pads; and a second USB device configured to comprise a USB female connector compatible both with the first and second groupings, the first USB device comprising:

a substrate on which the first and second groupings are arranged on a fore side of the substrate;

a male connector's fore-end part configured to surround the first and second groupings;

a housing configured to be joined to a base end of the male connector's fore-end part in order to cover at least a rear side of the substrate; and a plurality of lead wires each configured to have one end fixed to an inner surface of the housing and each being aligned with the second grouping corresponding to the lead wire, wherein when the male connector's fore-end part is inserted into a USB female connector of the second USB device, the lead wires are pushed onto the second grouping corresponding thereto by the USB female connector, and each of the lead wires comprises a curved part configured to be contacted with the USB female connector when the USB female connector receives the male connector's fore-end part, and a fore-end part of the male connector configured to be arranged closer to a leading end of the lead wire than the curved part in order to be pushed onto the second grouping corresponding to the lead wire when the curved part is contacted with the USB female connector.

7. The USB system of claim 6, wherein the housing comprises a first housing and a second housing vertically superposed on each other, and the lead wires are provided on an inner surface of one of the first housing and the second housing.

8. The USB system of claim 6, wherein the housing comprises a hole for putting a strap therethrough.

9. The USB system of claim 6, wherein the housing comprises a positioning member configured to position the substrate.

10. The USB system of claim 9, wherein the housing comprises a first housing and a second housing vertically superposed on each other, and the positioning member is provided on an inner surface of one of the first housing and the second housing which is different from the other housing having the lead wires.

* * * * *